US005584564A

United States Patent [19]

Phyle

[11] Patent Number: 5,584,564

[45] Date of Patent: Dec. 17, 1996

[54] BATTERY OPERATED LIGHTING APPARATUS

[76] Inventor: Charles E. Phyle, 6280 Brandywine, Holly, Mich. 48442

[21] Appl. No.: 552,086

[22] Filed: Nov. 2, 1995

[51] Int. Cl.[6] ..... A45B 3/02

[52] U.S. Cl. ..... 362/102; 362/191; 362/234; 362/431; 135/910

[58] Field of Search ..... 362/102, 27, 32, 362/184, 190, 191, 431, 234; 135/910, 161

[56] References Cited

U.S. PATENT DOCUMENTS

| | | | |
|---|---|---|---|
| 1,166,272 | 12/1915 | Smithing | 135/910 |
| 2,087,537 | 7/1937 | Finkel | 362/102 |
| 2,453,925 | 11/1948 | Mendonca . | |
| 3,036,206 | 5/1962 | Holbrook . | |
| 3,227,867 | 1/1966 | Baker | 362/102 |
| 3,313,929 | 4/1967 | Schiavone | 362/102 |
| 3,506,232 | 4/1970 | Wolar et al. | 248/320 |
| 3,723,723 | 3/1973 | Lerner | 362/123 |
| 3,870,062 | 3/1975 | Medlin | 135/26 X |
| 4,079,344 | 3/1978 | Lauben et al. | 335/2 |
| 4,174,532 | 11/1979 | Kelley | 362/102 |
| 4,848,385 | 7/1989 | Pennella | 135/16 |
| 4,860,179 | 8/1989 | Mui et al. | 362/102 |
| 5,053,931 | 10/1991 | Rushing | 362/102 |
| 5,126,922 | 6/1992 | Andreasen | 362/32 |
| 5,148,849 | 9/1992 | Faludy | 160/67 |
| 5,323,798 | 6/1994 | Yang | 135/16 |

OTHER PUBLICATIONS

Home Decorators Collection Magazine, Winter 1995 Edition, p. 53.

*Primary Examiner*—Stephen F. Husar
*Attorney, Agent, or Firm*—Harness, Dickey & Pierce, P.L.C.

[57] ABSTRACT

A battery operated lighting apparatus is provided particularly well suited for use in outdoor structures such as patio table umbrellas, dining canopies and tents. A housing containing a battery operated power source and an on/off switch is electrically connected to a lighting device for providing illumination to an outdoor structure. The present invention enables attachment of the housing to a support pole and attaching the lighting device to a member of an outdoor structure whereby battery powered illumination can be provided thereto.

30 Claims, 9 Drawing Sheets

BATTERY OPERATED LIGHTING APPARATUS

FIELD OF THE INVENTION

The present invention relates to an apparatus for attachment to an outdoor structure which provides illumination thereto and, more specifically, to a battery operated lighting apparatus that is especially adapted for use with a patio table umbrella or similar structures having a support pole.

BACKGROUND AND SUMMARY OF THE INVENTION

Most patio tables are adapted to receive and support a table umbrella thereon to provide shade, aesthetics and comfort to the table occupants. While daytime use of the table and umbrella combination is quite enjoyable, nighttime use becomes burdensome due to the need to provide illumination to the table through the use of an offstanding lighting apparatus, an AC dependent lighting apparatus or other means of lighting which is not specifically designed for table illumination. Furthermore, the umbrella canopy in some cases must be collapsed from a raised position to a lowered position to alleviate excessive blocking of light and thereby permit illumination of the table through one of the above mentioned means. Consequently the ambiance of the table/umbrella combination is destroyed.

It is, therefore, desirable to provide a battery operated lighting apparatus having a housing adapted to be secured to the umbrella support pole and electrically connected to at least one lighting device flexibly secured to an umbrella rib. It is further desirable to provide a battery operated lighting apparatus capable of remaining secured to the umbrella as the canopy is raised and lowered. Thus, the present invention is particularly well suited for use in outdoor structure applications where it is desirable to provide non-AC dependent illumination thereto. While the following is not to be interpreted as limiting, examples of preferred outdoor structure applications include patio table umbrellas, tarps, dining canopies, tents and other structures having a support pole and at least one elongated member extending therefrom.

In general, the battery operated lighting apparatus of the present invention comprises a waterproof housing containing a battery operated power source and an on/off switch electrically connected to at least one lighting device. The lighting apparatus further comprises a means for attaching the lighting device to an elongated member of an outdoor structure and a second means for attaching the housing to a support pole. In the preferred embodiment, the housing includes a passageway extending from a top surface to a bottom surface and a hinge adjacent the passageway arranged to permit the housing to pivot to an open position to allow the support pole of the outdoor structure to pass into the housing and further arranged to permit the housing to be closed about the pole for attachment thereto.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
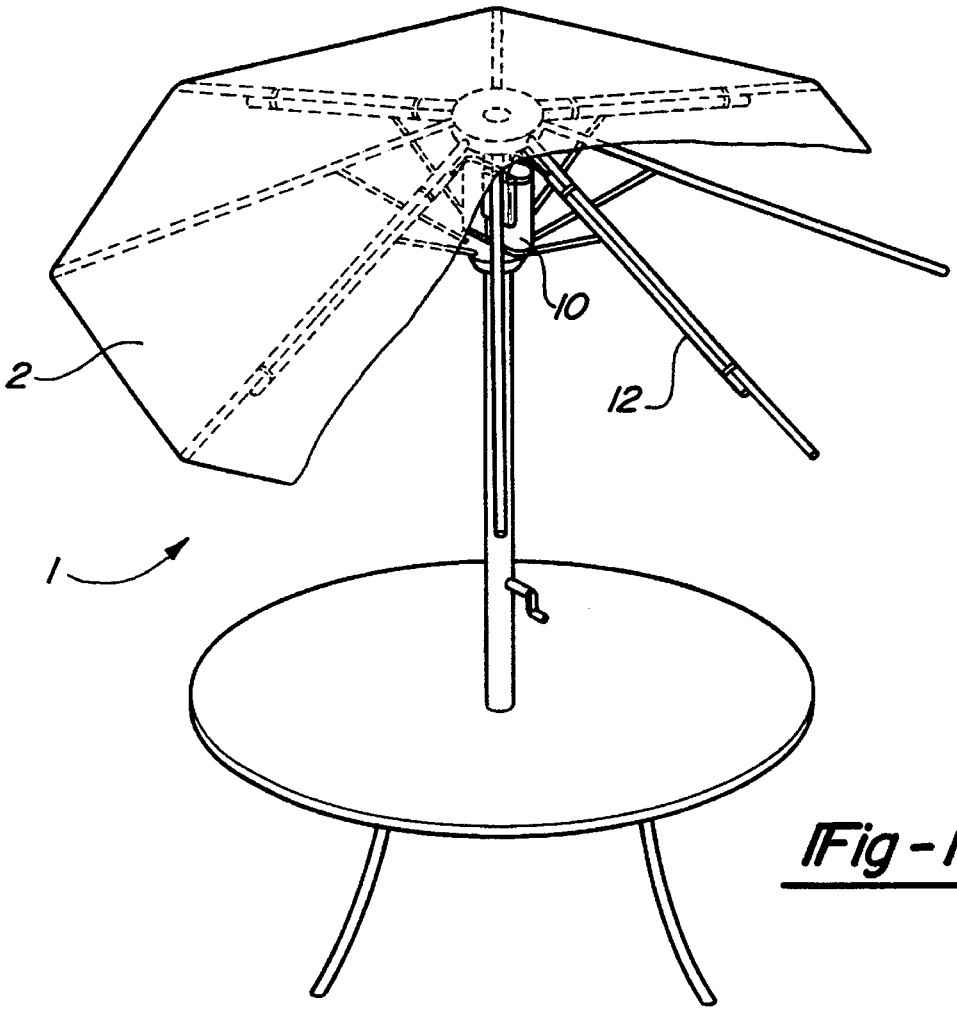
FIG. 1 is a perspective view of the lighting apparatus according to the present invention attached to a patio table umbrella with the umbrella partially cut away and the structure shown in phantom.

Referring to FIG. 1, an apparatus for providing illumination to an outdoor structure is shown. In particular, a patio table having an umbrella secured thereto is generally indicated by the reference numeral 1. A housing 10 and lighting devices 12 are secured to the umbrella 1 for providing illumination beneath the canopy 2.

Figure 2:
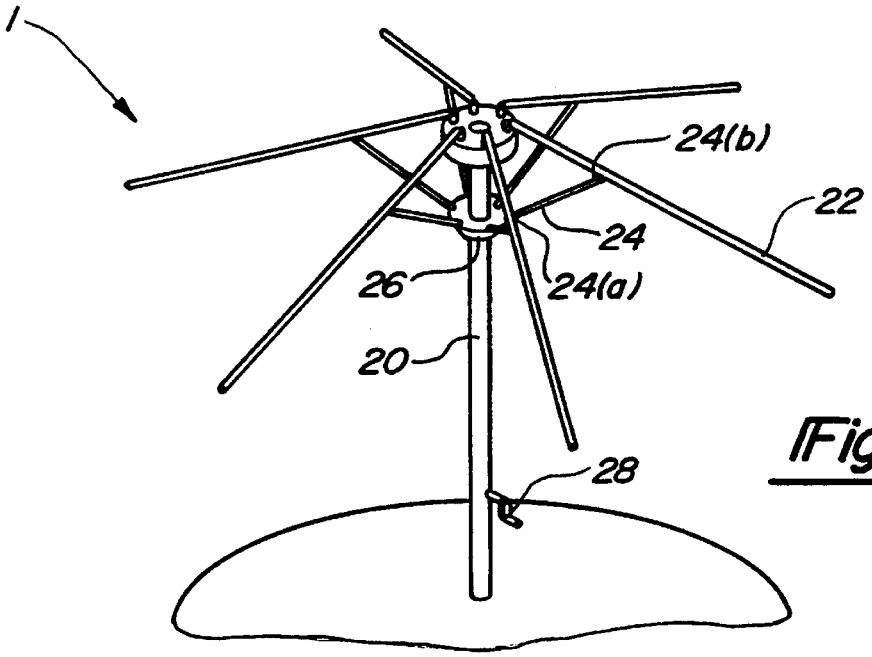
FIG. 2 is a schematic view of the umbrella structure absent the lighting apparatus.
Figure 3:
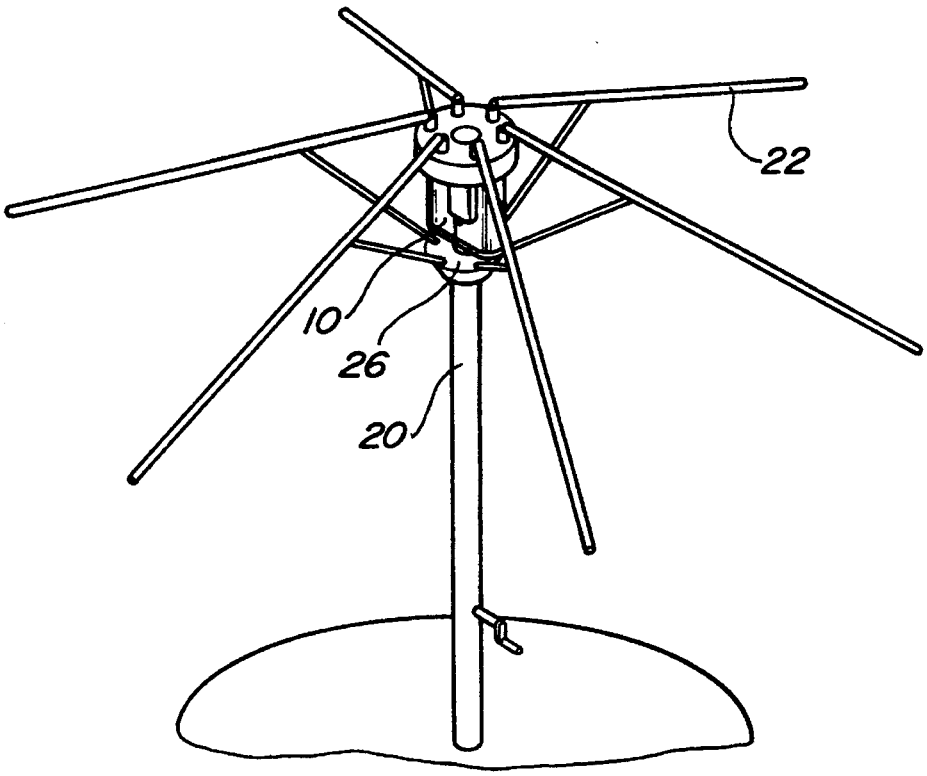
FIG. 3 is a schematic view of the umbrella structure and housing according to the present invention.
Figure 4:
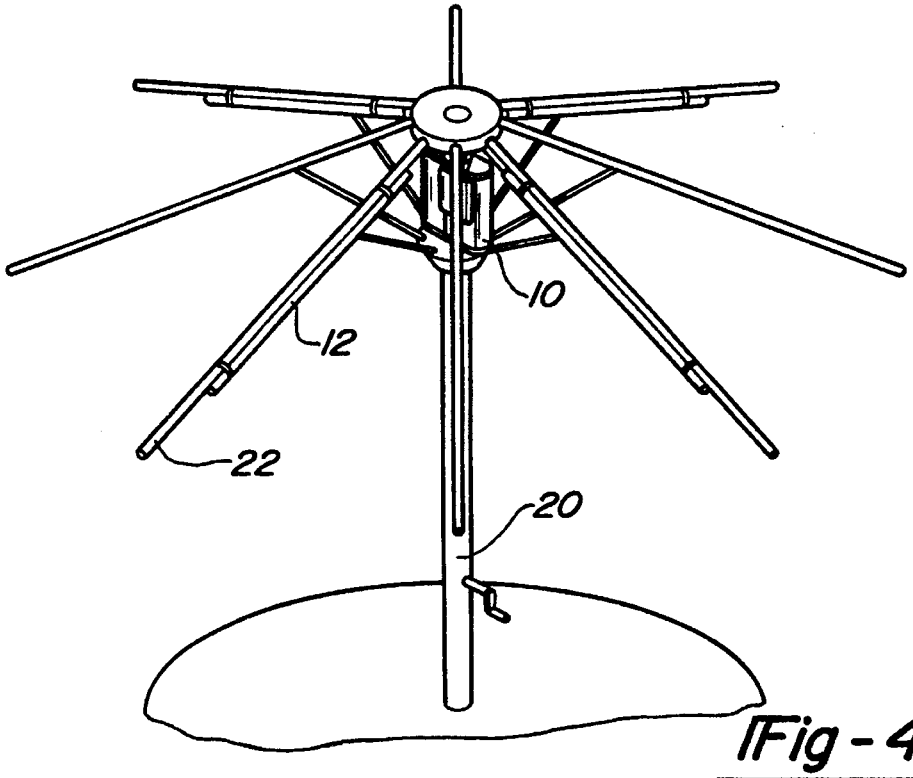
FIG. 4 is a schematic view of the umbrella structure, housing and lighting device according to the present invention.

Referring also now to FIGS. 2, 3 and 4, the patio table umbrella 1 generally includes a support pole 20 for supporting ribs 22 extending therefrom. Struts 24 are pivotably connected to the ribs 22 at a first end 24(*a*) and are pivotally connected to a slide 26 at a second end 24(*b*). The slide 26 is slidably connected about the support pole 20 for vertical movement thereon. A rotatable handle 28 is operably connected to the slide 26 for providing movement thereto. Therefore, rotation of the handle 28 causes corresponding vertical movement of the slide 26 along the support pole 20 thereby moving the ribs 22 between a raised position and a lowered position via the struts 24.

The housing 10, to be described in greater detail below, is shown in FIGS. 3 and 4 attached about the support pole 20. In a preferred embodiment, the housing 10 is located above the slide 26 where it will not interfere with the vertical movement of the slide 26 as the canopy 2 (not shown) is moved between a raised position and a lowered position via ribs 22. As shown in FIG. 4, at least one lighting device 12 is secured to a rib 22 for providing light thereunder. In the preferred embodiment, lighting devices 12 having a substantially elongated configuration are used although other lighting device configurations are equally appropriate.

Figure 5:
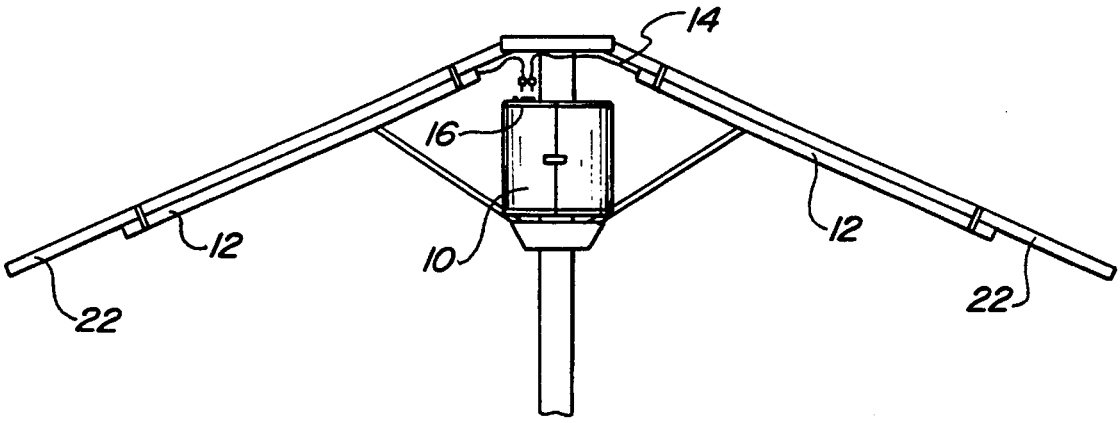
FIG. 5 is a side schematic view of the lighting apparatus according to the present invention.

Referring to FIG. 5, the elongated lighting devices 12 are secured to the ribs 22 and are shown in an electrically disconnected configuration. The lighting device 12 is flexibly connected through a conducting element 14, preferably an insulated cable, to the housing 10 by inserting an end 14(*a*) of conducting element 14 into one of receptacles 16. In the configuration shown, a selective lighting arrangement is provided corresponding to the combination of lighting devices 12 connected or disconnected to the housing 10 through receptacles 16. Due to the primarily outdoor applications of the present invention, the housing 10, lighting devices 12 and electrical connections therebetween are preferably resistant to water penetration.

Figure 6:
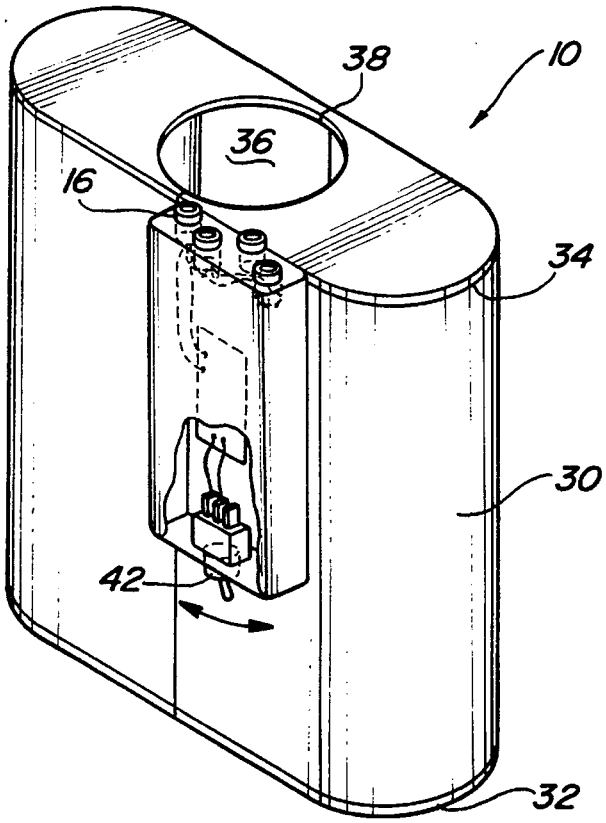
FIG. 6 is a perspective view of the housing in a closed position according to the present invention.
Figure 7:
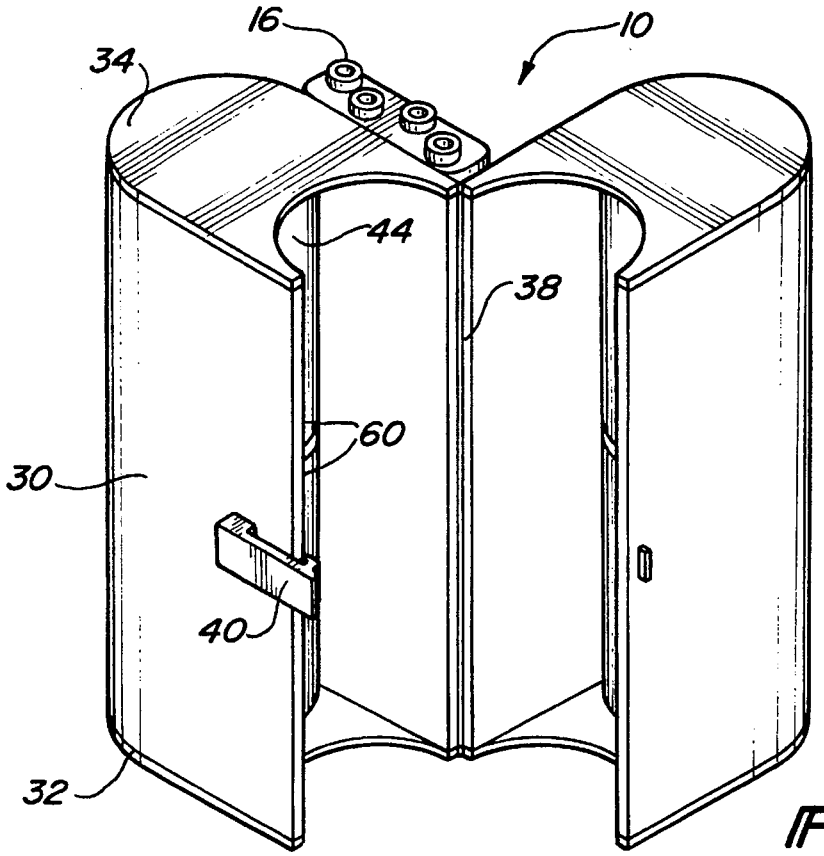
FIG. 7 is a perspective view of the housing in an open position according to the present invention.
Figure 8:
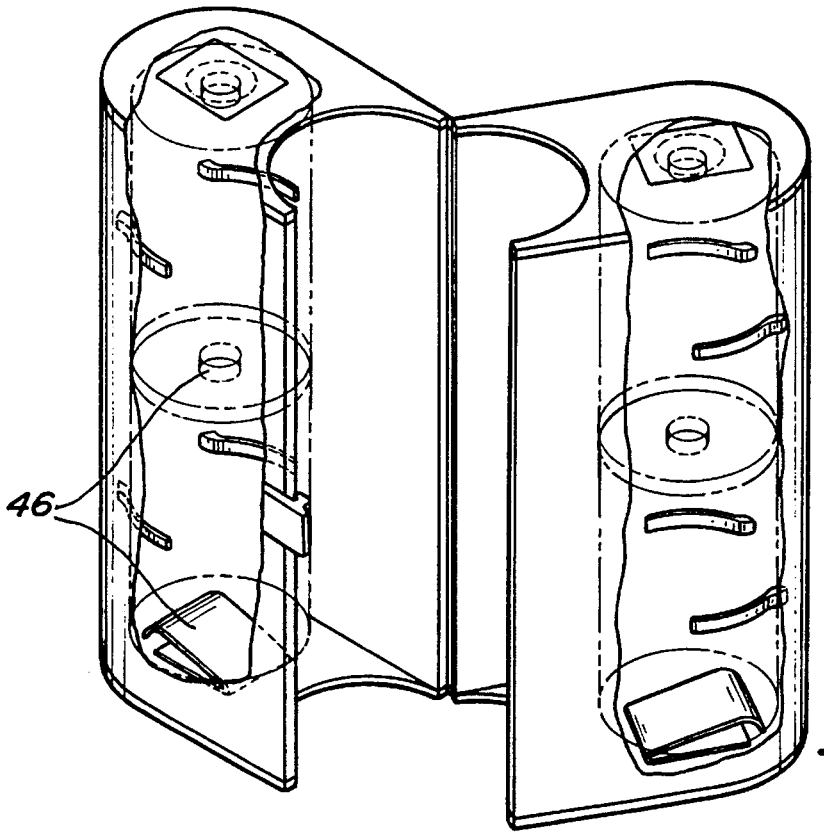
FIG. 8 is a perspective view of the housing in an open position having partial cutaways showing the battery contacts therein.

Referring to FIGS. 6, 7 and 8, the housing 10 of the lighting apparatus according to the present invention will now be described in greater detail. The housing 10 includes a case 30 and bottom and top surfaces 32 and 34, respectively. The housing 10 includes a passageway 36 extending from the bottom surface 32 to the top surface 34 for receiving the support pole 20 (not shown) of the umbrella structure. A hinge 38 is provided adjacent the passageway 36 for allowing the housing 10 to pivot to an open position and back to a closed position. In the preferred embodiment, hinge 38 is a "living hinge" although other equivalents may be used.

A latch 40 is positioned opposite the hinge 38 and adjacent the passageway 36 for locking the housing 10 in a closed position. In this way, the latch 40 can be released to enable the housing 10 to pivot along the hinge 38 to an open position for receiving the support pole 20 into the passageway 36. Upon receiving the support pole 20 into the passageway 36, the housing 10 is closed about the support pole 20 and locked in a closed position by the latch 40.

An on/off switch 42 is provided to permit selective electrical communication between the power source enclosed within the housing 10 (to be described in greater detail below) and the lighting devices 12. As can be seen more clearly in FIG. 8, the housing 10 is provided with battery contacts 46 for supporting batteries 60 which provide power for the lighting devices 12. Also, FIGS. 6 and 7 clearly show the receptacles 16 for flexibly connecting a conducting element 14 to the housing 10. Due to the intended outdoor use of the present invention, it is desirable to ensure that the on/off switch 42 and receptacles 16 are waterproof.

Figure 9:
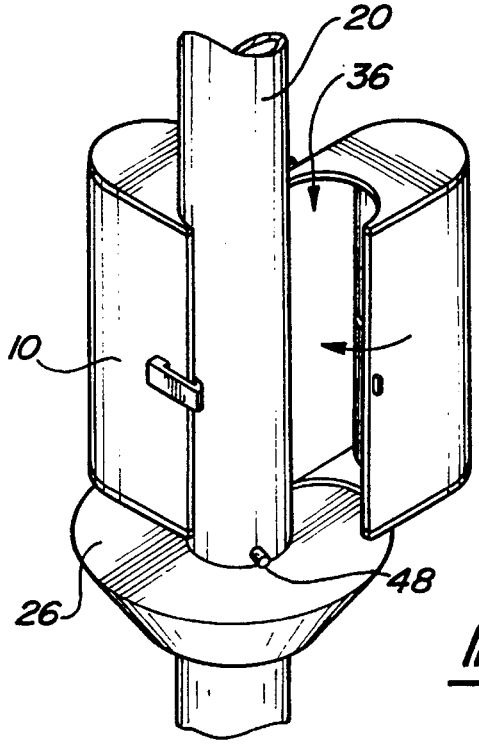
FIG. 9 is a perspective view of the housing as it is being close about to the support pole of an umbrella according to the present invention.
Figure 10:
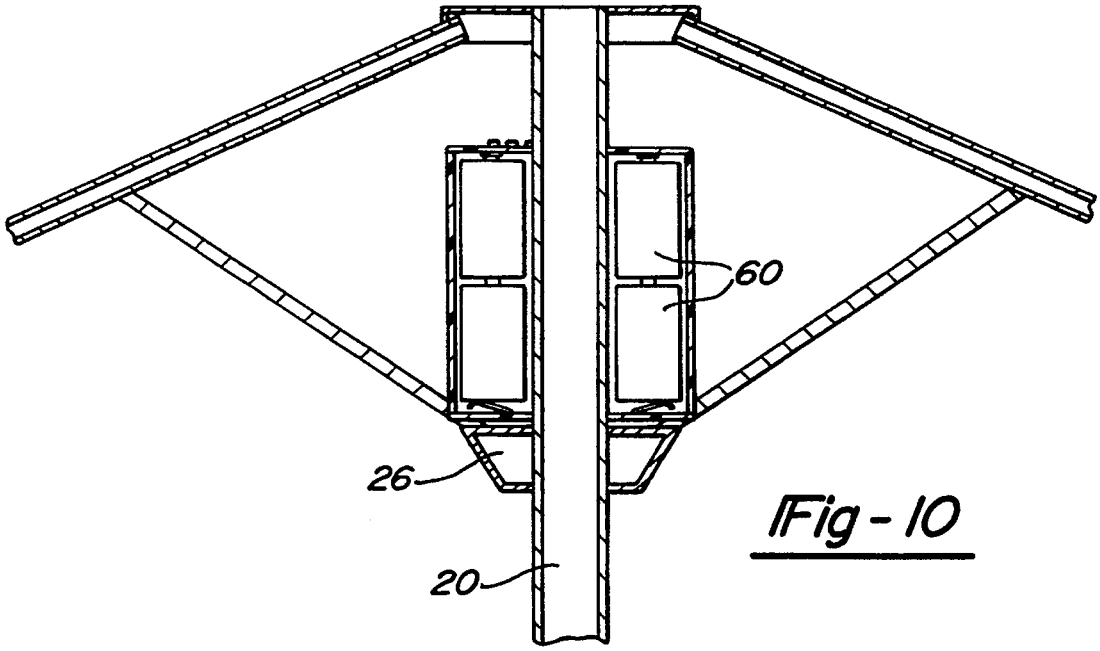
FIG. 10 is a side schematic view of the housing secured about the support pole showing the batteries located therein.

Referring to FIGS. 9 and 10, in the preferred embodiment of the present invention, the housing 10 is attached to the support pole 20 by passing the support pole 20 into the passageway 36 of the housing 10 above the slide 26. In this way, the housing 10 will not interfere with the vertical motion of the slide 26 as the canopy 2 (not shown) is raised and lowered. If the umbrella is of the type having a stop member 48, the housing 10 is preferably located about the support pole 20 above the stop member 48 thereby providing greater ease of vertical motion of the slide 26. This configuration permits the housing 10 to remain stationary about the support pole 20 above the stop member 48 as the canopy is raised and lowered through vertical motion of the slide 26. In umbrellas of the type without stop member 48, the housing 10 can be arranged so that friction between the support pole 20 and top and bottom surfaces 32 and 34 along passageway 36 support the housing 10.

It is also preferred to have the batteries 60 within the housing 10 aligned parallel to the support pole 20, although other arrangements are acceptable. The parallel alignment of the batteries 60 with the support pole 20 ensure that the housing 10 is narrow enough so as to not interfere or excessively contact the canopy 2 as it is folded or stored in its lowered position.

Figure 11:
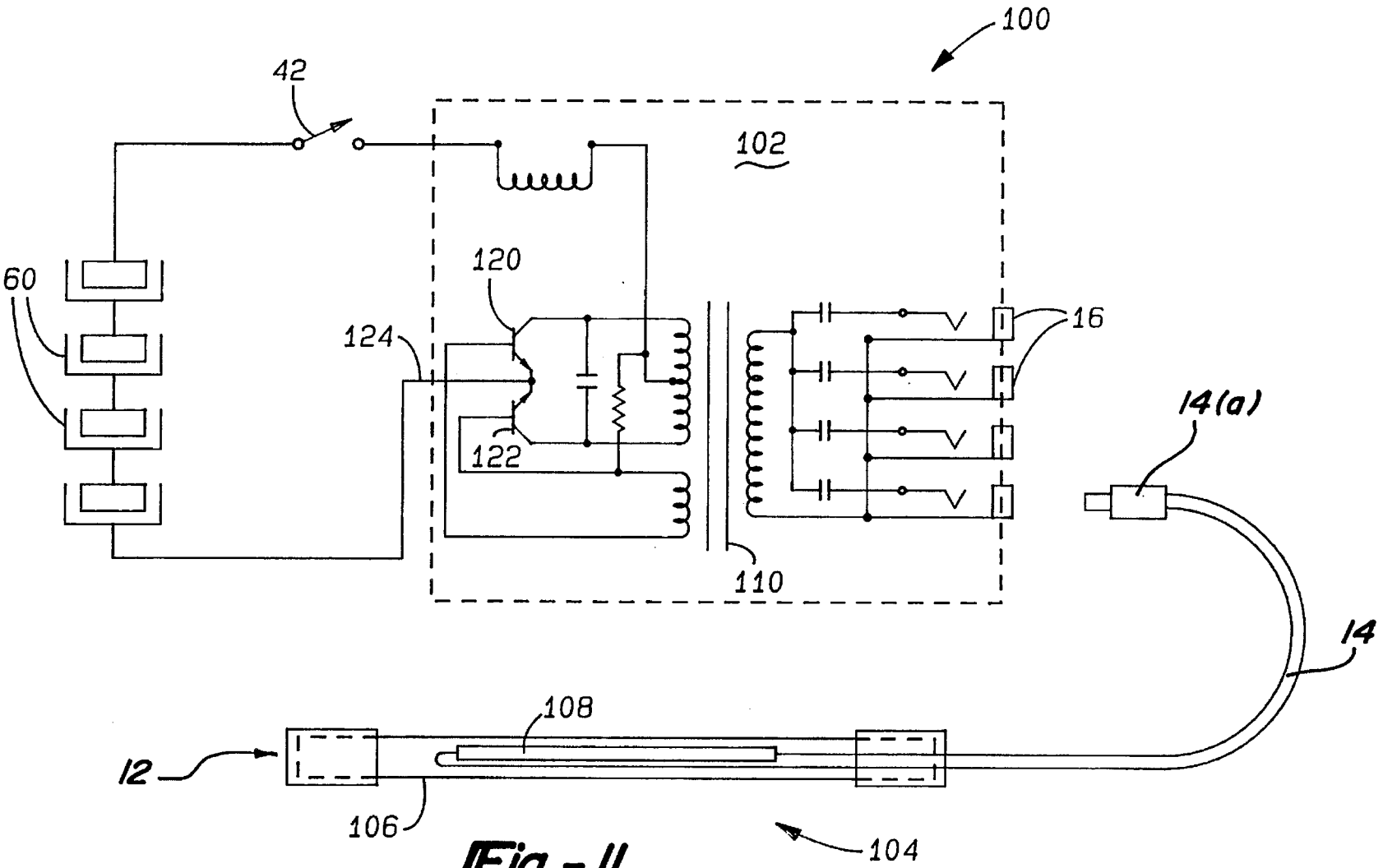
FIG. 11 is a circuit diagram and lighting device according to the present invention.
Figure 12:
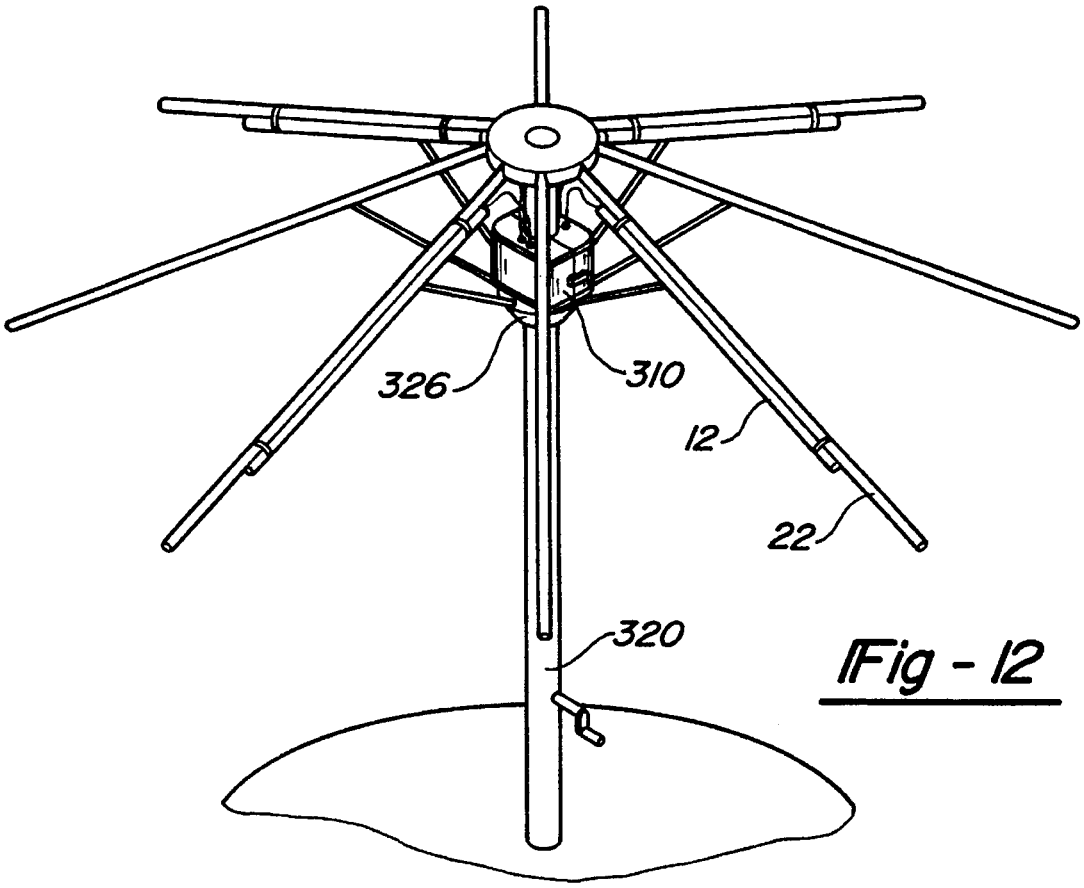
FIG. 12 is a perspective view of a second embodiment of the present invention.
Figure 13:
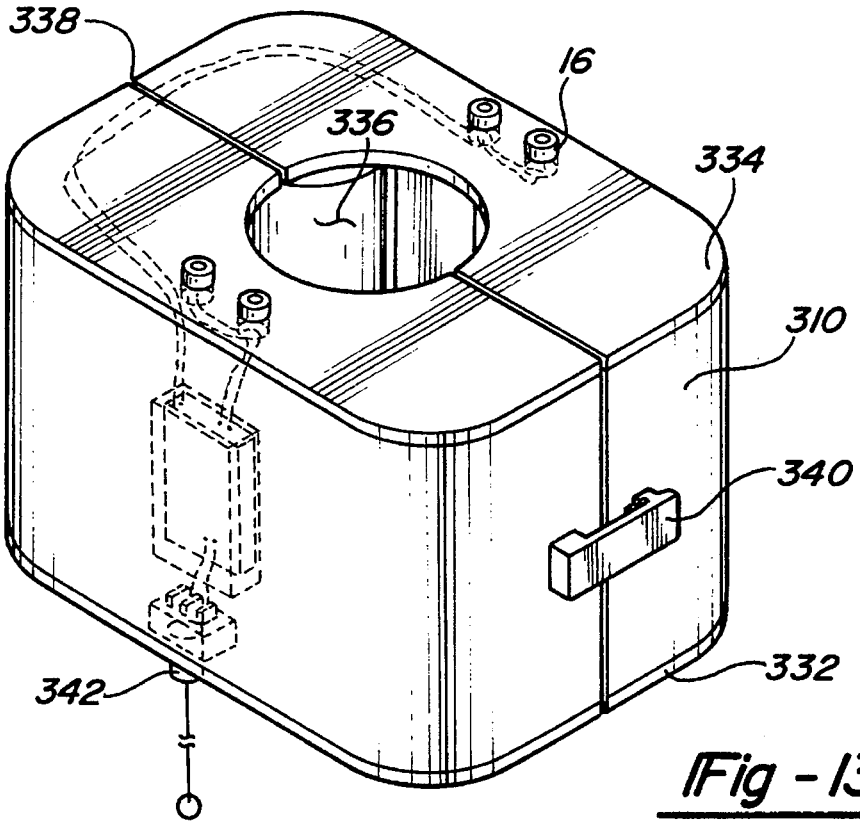
FIG. 13 is a perspective view of a housing of the second embodiment in a closed position.
Figure 14:
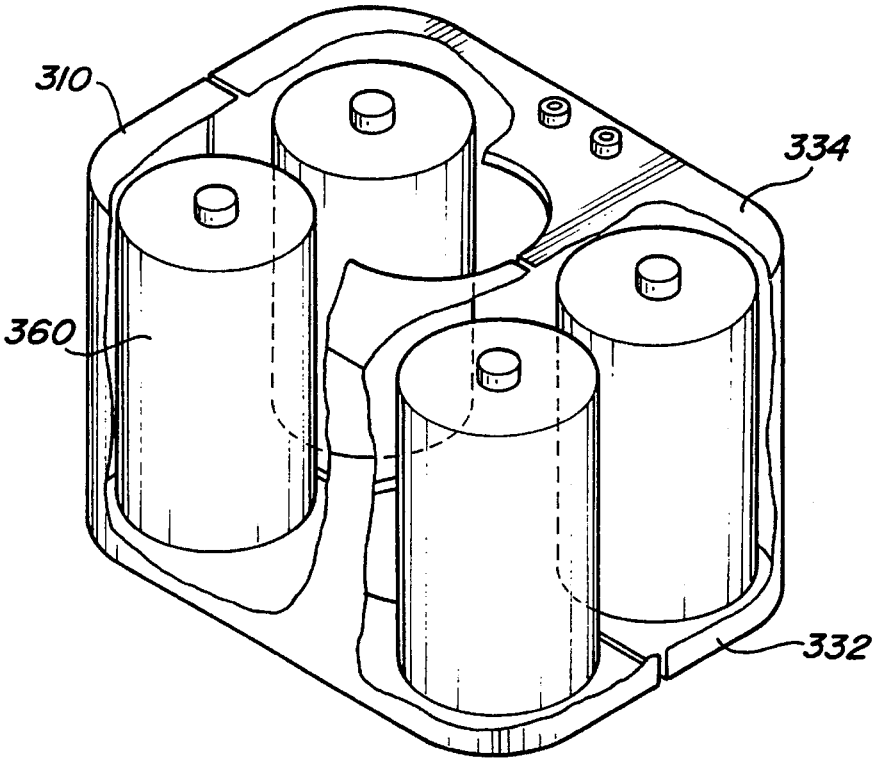
FIG. 14 is a perspective view of the housing of the second embodiment having cutaways showing the battery arrangement therein.
Figure 15:
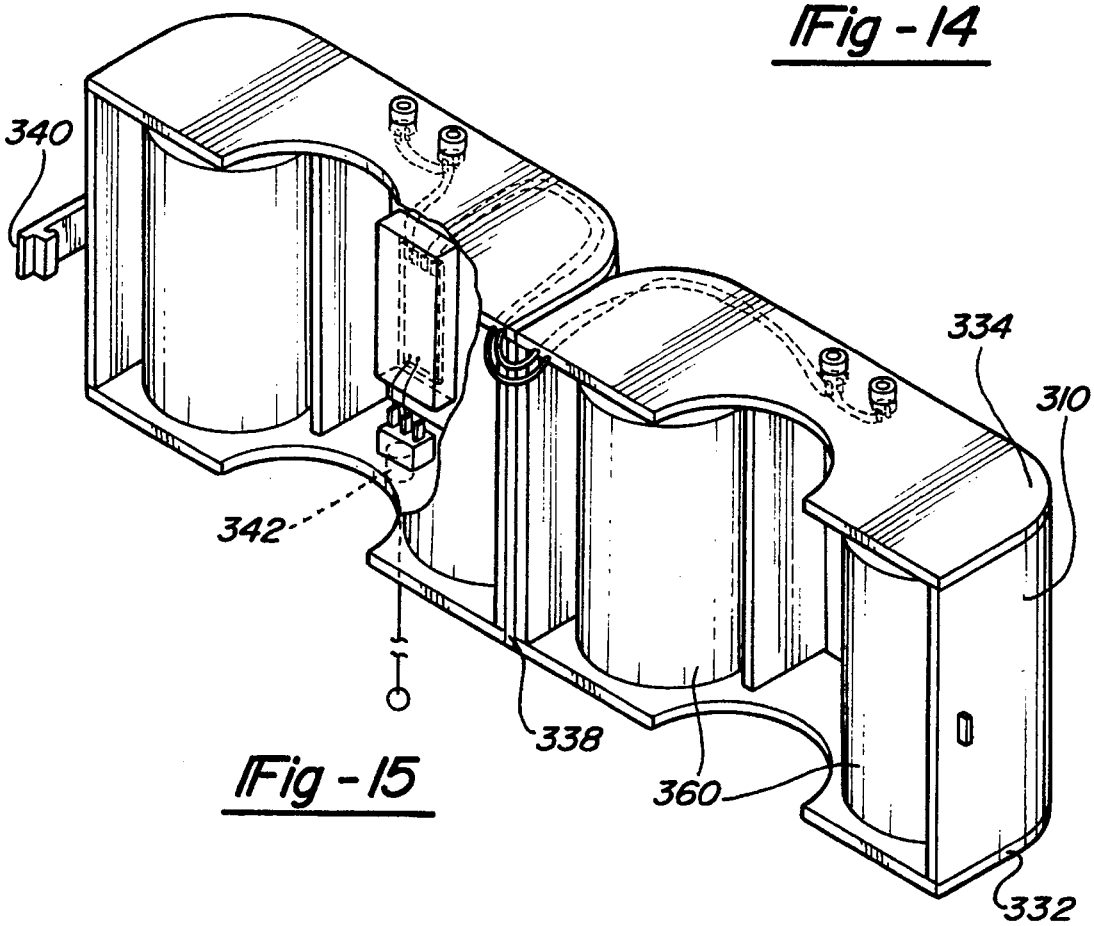
FIG. 15 is a perspective view of the housing of a second embodiment in an open position.
Figure 16:
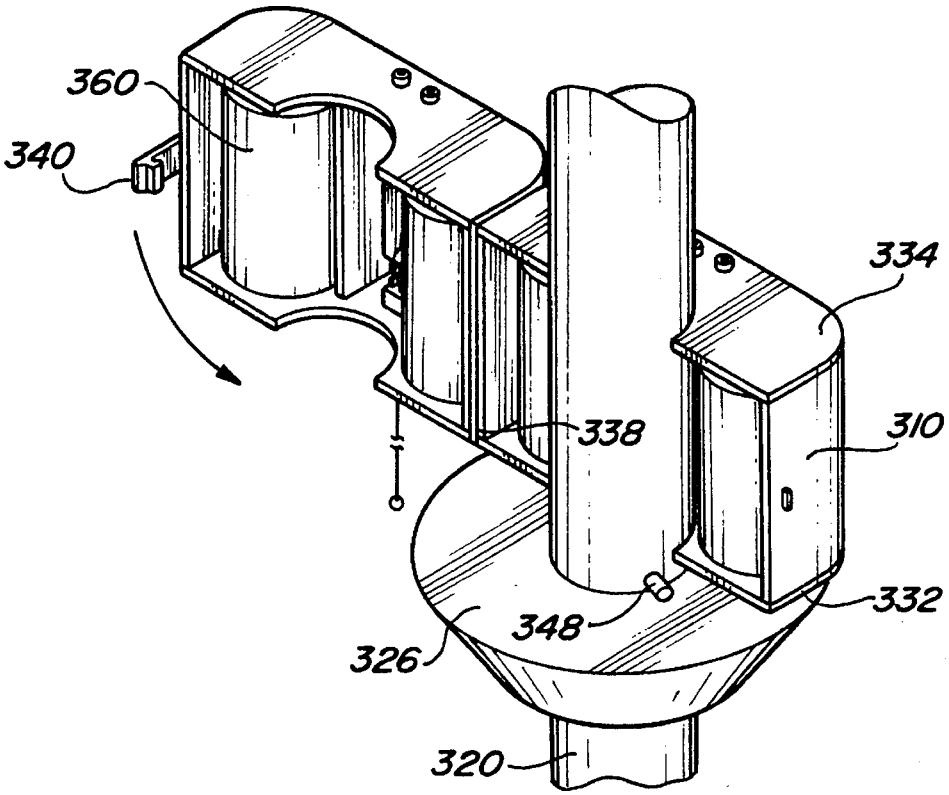
FIG. 16 is a perspective view of the housing according to the second embodiment of the present invention as it is being closed about a support pole.
Figure 17:
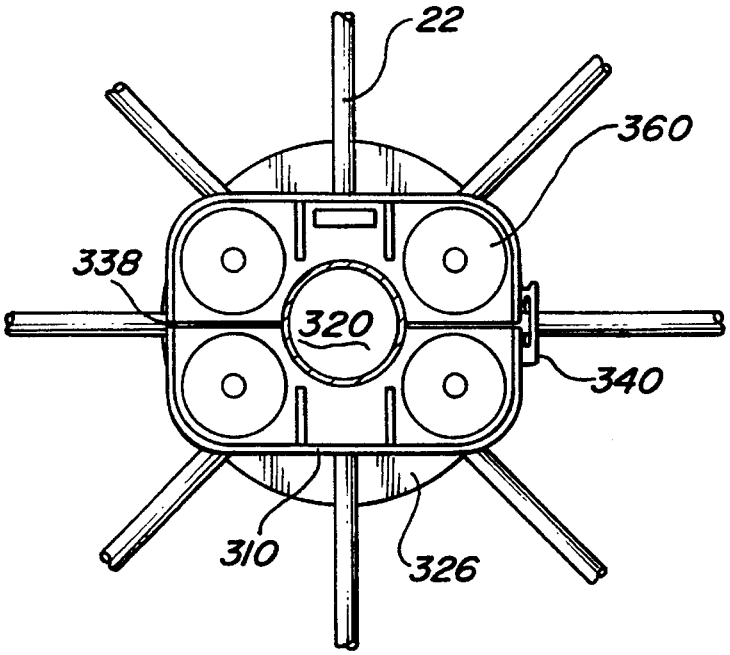
FIG. 17 is an elevation view of the second embodiment of the housing according to the present invention.

Referring now to FIG. 11, a circuit diagram representing the power source and step up circuitry is generally designated by the reference numeral 100. Preferably, the circuitry is housed in a waterproof box. Batteries 60 are connected through the on/off switch 42 to step up circuitry 102, which is known in the art, for raising the voltage from the batteries 60 to an appropriate level for powering the lighting devices. Step up circuitry 102 generally includes transistors 120 and 122 arranged to form an oscillator. Transistors 120 and 122 are coupled to receptacles 16 through flyback inverter transformer 110. It is to be understood that while step up circuitry 102 is preferred in the present invention, other arrangements suitable for raising the voltage at the batteries 60 to a level required to power the lighting devices 12 are anticipated.

Although the step up circuitry 102 may be used for many applications, it is particularly suitable for use in conjunction with the preferred lighting devices 12 of the present invention. Lighting devices 12 include a light wand 104 having a transparent outer sheath 106 and at least one elongated fluorescent filament element 108 located therein. This elongated configuration is particularly well suited for use in conjunction with the umbrella ribs 22 since its elongated arrangement enables the lighting devices 12 to remain secured to the ribs in any umbrella position.

A second embodiment of the present invention is shown in FIGS. 12–17. In this embodiment, a housing 310 contains batteries 360 in parallel alignment with the support pole 320. However, in this embodiment, the batteries 360 are arranged side-by-side on a single level as opposed to the "stacked" two level configuration of the first embodiment. Therefore, this embodiment permits the housing 310 to have a shorter height between the bottom surface 332 and the top surface 334 allowing for particularly advantageous use on outdoor structures, such as some patio table umbrellas, having a location for attachment with limited vertical space.

Similar to the first embodiment, the housing 310 includes a passageway 336 extending from the bottom surface 332 to the top surface 334 for receiving a support pole 320 therein. A hinge 338 is provided adjacent the passageway 336 for permitting the housing 310 to pivot to an open position and back to a closed position. A latch 340 is provided for locking the housing 310 about the support pole 320. An on/off switch 342 is provided for permitting electrical communication to the lighting devices 12. In this embodiment, a pull-chain type switch is shown as opposed to the toggle type of the first embodiment.

The second embodiment is also preferably attached to a support pole 320 above the slide 326 or above a stop member 348, if one is present, thereby assuring the lighting apparatus does not interfere with the vertical motion of the slide 326 as the canopy 302 (not shown) is moved between a raised and lowered position.

It will be appreciated that the lighting apparatus according to the present invention enables nighttime use of outdoor structures. It is particularly well suited for use in combination with a patio table umbrella where battery powered illumination under the canopy is desirable. Moreover, the lighting apparatus of the present invention will not interfere with the movement of the umbrella canopy between a raised or lowered position.

While the above description constitutes the preferred embodiments of the invention, it will be appreciated that the invention is susceptible to modification, variation and change without departing from the proper scope or fair meaning of the accompanying claims.

What is claimed is:

1. An apparatus for lighting an outdoor structure having at least one support pole and at least one elongated member extending therefrom, said apparatus comprising:

a housing containing a battery operated power source and an on/off switch, said housing including a passageway extending from a top surface to a bottom surface thereof for receiving the support pole;

at least one lighting device;

first means for attaching the lighting device to the elongated member;

second means for attaching the housing to the support pole; and third means for electrically connecting the lighting device through the on/off switch to the battery operated power source;

whereby the apparatus can be attached to the outdoor structure for providing battery powered illumination thereto.

2. The apparatus of claim 1 wherein the structure is an umbrella and the elongated member is a rib for supporting a canopy.

3. The apparatus of claim 1 wherein the housing further comprises:

a hinge adjacent the passageway arranged to permit the housing to pivot to an open position to allow the support pole to pass into the passageway, with the hinge further being arranged to permit the housing to be closed about the support pole for attachment thereto.

4. The apparatus of claim 1 which further includes a plurality of lighting devices which are respectively attached to the umbrella ribs.

5. The apparatus of claim 1 wherein the structure includes a stop member located on an upper portion of the support pole and wherein the housing is attached to the support pole above the stop member.

6. The apparatus of claim 1 wherein the housing includes a plurality of receptacles and wherein the lighting devices are removably attached to the receptacles.

7. The apparatus of claim 1 wherein the lighting devices each comprise:

a light wand having a transparent outer sheath and at least one elongated fluorescent filament element located therein.

8. The apparatus of claim 7 wherein the housing further comprises:

step-up circuitry electrically connected to the battery power source for raising voltages from the power source for powering the fluorescent filament elements.

9. The apparatus of claim 1 wherein the housing further comprises:

step-up circuitry electrically connected to the battery power source for raising voltages from the power source for powering the lighting device.

10. The apparatus of claim 1 wherein the housing contains a plurality of batteries, each battery being mounted in the housing parallel with the axis of the support pole.

11. The apparatus of claim 2 wherein the lighting devices are connected to the housing to permit the lighting devices to travel with the ribs of the umbrella as the canopy is raised and lowered.

12. An apparatus for lighting an umbrella having at least one support pole including a stop member located on an upper portion thereof, and at least one rib extending from the support pole for supporting a canopy, the apparatus comprising:

a housing attached to the support pole above the stop member containing a battery operated power source and an on/off switch;

a plurality of batteries, each battery being mounted in the housing parallel with the axis of the support pole;

a passageway extending from a top surface to a bottom surface of the housing for receiving the support pole;

a hinge adjacent the passageway arranged to permit the housing to pivot to an open position to allow the support pole to pass into the passageway, with the hinge further being arranged to permit the housing to be closed about the pole for attachment thereto;

a plurality of light wands having a transparent outer sheath and at least one elongated fluorescent filament element located therein attached to the umbrella ribs and flexibly connected to the housing to permit the light wands to travel with the ribs of the umbrella as the canopy is raised and lowered;

a plurality of receptacles arranged to permit removable attachment of the light wands to the housing; and step-up circuitry electrically connected to the battery power source for raising voltages from the power source for powering the fluorescent filament elements.

13. A method of illuminating a structure having at least one pole, said method comprising:

providing a housing having at least one battery therein;

attaching the housing to the pole;

connecting at least one lighting device to the structure; and electrically connecting the lighting device to the battery in the housing so that the structure can be illuminated without requiring the lighting devices to be plugged into an alternating current (AC) receptacle.

14. The method of claim 13 wherein the structure is an umbrella having a stop member located at an upper portion of the pole, with the umbrella further including a plurality of ribs for supporting a canopy, said method further comprising:

clamping the housing to the pole above the stop member;

attaching the lighting devices to the ribs; and removably electrically connecting the lighting devices to the battery in the housing by way of a flexible connection to permit the lighting devices to travel with the ribs as the canopy is raised and lowered.

15. The method of claim 13 wherein the housing comprises:

a passageway extending from a top surface to a bottom surface thereof for receiving the pole; and a hinge adjacent the passageway arranged to permit the housing to pivot to an open position to permit the pole to pass into the passageway, with the hinge further being arranged to permit the housing to be closed about the pole for attachment thereto.

16. An apparatus for lighting an outdoor structure having at least one support pole and at least one elongated member extending therefrom, said apparatus comprising:

a housing containing a battery operated power source and an on/off switch;

at least one light wand having a transparent outer sheath and at least one elongated fluorescent filament element located therein;

first means for attaching the light wand to the elongated member;

second means for attaching the housing to the support pole; and third means for electrically connecting the light wand through the on/off switch to the battery operated power source;

whereby the apparatus can be attached to the outdoor structure for providing battery powered illumination thereto.

17. The apparatus of claim 16 wherein the structure is an umbrella and the elongated member is a rib for supporting a canopy.

18. The apparatus of claim 16 wherein the housing includes a passageway extending from a top surface to a bottom surface thereof for receiving the support pole.

19. The apparatus of claim 16 wherein the housing further comprises:

a hinge adjacent the passageway arranged to permit the housing to pivot to an open position to allow the support pole to pass into the passageway, with the hinge further being arranged to permit the housing to be closed about the support pole for attachment thereto.

20. The apparatus of claim 16 which further includes a plurality of light wands which are respectively attached to the elongated members.

21. The apparatus of claim 16 wherein the support pole includes a stop member located on an upper portion thereof and wherein the housing is attached to the support pole above the stop member.

22. The apparatus of claim 16 wherein the housing includes a plurality of receptacles and wherein the light wands are removably attached to the receptacles.

23. The apparatus of claim 16 wherein the housing further comprises:

step-up circuitry electrically connected to the battery power source for raising voltages from the power source for powering the light wands.

24. The apparatus of claim 16 wherein the housing contains a plurality of batteries, each battery being mounted in the housing parallel with the axis of the support pole.

25. The apparatus of claim 17 wherein the light wands are flexibly connected to the housing to permit the light wands to travel with the ribs of the umbrella as the canopy is raised and lowered.

26. A method of illuminating an umbrella comprising:

attaching a housing containing a battery operated power source and an on/off switch to a support pole of said umbrella;

securing at least one light wand having a transparent outer sheath and at least one elongated fluorescent filament element located therein to an elongated member extending from said support pole; and electrically connecting said light wand to said battery operated power source through said on/off switch.

27. The method of claim 26 wherein the housing includes a passageway extending from a top surface to a bottom surface thereof for receiving the support pole; and a hinge adjacent the passageway arranged to permit the housing to pivot to an open position to permit the support pole to pass into the passageway, with the hinge further being arranged to permit the housing to be closed about the support pole for attachment thereto.

28. The method of claim 26 wherein the support pole includes a stop member located at an upper portion thereof and wherein the housing is attached to the support pole above the stop member.

29. The method of claim 26 wherein the light wand is flexibly connected to the power source to permit the light wand to travel with the elongated member of the umbrella.

30. The method of claim 26 wherein the housing includes at least one receptacle and wherein the light wand is removably coupled to the receptacle.

* * * * *